US008011744B2

(12) United States Patent
Lim et al.

(10) Patent No.: US 8,011,744 B2
(45) Date of Patent: Sep. 6, 2011

(54) REFRIGERATOR WITH TRAY COVER

(75) Inventors: Jae Hoon Lim, Suwon-si (KR); Youn Tae Shin, Gwangju (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 622 days.

(21) Appl. No.: 12/071,796

(22) Filed: Feb. 26, 2008

(65) Prior Publication Data

US 2008/0203876 A1 Aug. 28, 2008

(30) Foreign Application Priority Data

Feb. 26, 2007 (KR) ..... 10-2007-0019186

(51) Int. Cl.
*A47B 88/04* (2006.01)
*F25D 25/00* (2006.01)

(52) U.S. Cl. ..... 312/404; 312/311

(58) Field of Classification Search ..... 312/401, 312/402, 404, 405, 410, 294, 311, 330.1, 312/408; 62/382; 16/266
See application file for complete search history.

(56) References Cited

U.S. PATENT DOCUMENTS 2,132,737 A * 10/1938 Kahn ..... 126/340
2,246,342 A * 6/1941 Brown ..... 62/266
2,381,598 A * 8/1945 Jones ..... 312/291
3,339,994 A * 9/1967 Reddig et al. ..... 312/301
3,471,874 A * 10/1969 Dixon ..... 4/240
4,732,435 A * 3/1988 Bailey et al. ..... 312/311
5,947,573 A * 9/1999 Tovar et al. ..... 312/404
6,834,922 B2 * 12/2004 Cho ..... 312/331
2005/0073226 A1 * 4/2005 Antos et al. ..... 312/404

FOREIGN PATENT DOCUMENTS

KR 10-2004-0056342 6/2004
KR 10-2006-0032686 4/2006

* cited by examiner

*Primary Examiner* — James O Hansen
(74) *Attorney, Agent, or Firm* — Staas & Halsey LLP

(57) ABSTRACT

A refrigerator includes a main body, a receiving portion defined within the main body, a shelf disposed within the receiving portion having at least one auxiliary hinge portion disposed at a rear thereof, a storage tray slidably extractable from within the receiving portion and adjacent the shelf when the storage tray is received within the receiving portion, and a front cover disposed on a front surface of the storage tray to be rotated upward and opened when the storage tray is extracted from within the receiving portion and having at least one holder portion disposed on a rear surface thereof to be coupled to the at least one auxiliary hinge portion. By the configuration, the front cover is structurally reinforced, and it is possible to prevent the front cover from drooping and prevent a gap between the front cover and the upper shelf.

7 Claims, 6 Drawing Sheets

(A)

(B)

(A)

(B)

REFRIGERATOR WITH TRAY COVER

CROSS-REFERENCE TO RELATED APPLICATIONS

This application claims the benefit of Korean Patent Application No. 2007-0019186, filed on Feb. 26, 2007 in the Korean Intellectual Property Office, the disclosure of which is incorporated herein by reference.

BACKGROUND

1. Field

The present invention relates to a refrigerator including a support portion and a holder portion to prevent a central portion of a front cover from drooping down when a storage tray is opened.

2. Description of the Related Art

A refrigerator is an apparatus to store food in a fresh state by heat exchange based on a temperature difference generated in a phase change of a coolant during the compression, condensation, and expansion of the coolant, such as Freon or methane, for example.

Generally, the refrigerator includes a main body serving as an external body, a freezing chamber and a cooling chamber which are disposed in the main body as storage chambers with open front surfaces, and doors hinge-coupled to a front portion of the main body to open and close the freezing chamber and the cooling chamber.

A plurality of shelves is respectively provided in the freezing chamber and the cooling chamber such that food can be stored on the shelves. Recently, a separate space maintained at a separate temperature range is disposed in the refrigerator to provide an optimal temperature range according to types of food.

For example, a vegetable compartment to store vegetables and fruits and a special cooling room to store food, such as fish that specially requires freshness, are installed in a drawer at a lower side of the cooling chamber.

Generally, in the refrigerator for home use, a user can control the temperature of the chambers such that the freezing chamber is maintained at a temperature range of about −12° C. to −24° C., for example, and the cooling chamber is maintained at a temperature range of about 0° C. to 7° C., for example.

Further, the vegetable compartment is maintained at a temperature range of about 5° C. to 10° C., for example, and the special cooling room is maintained at a temperature range of about 1° C. to 3° C., for example.

Generally, for the special cooling room of the refrigerator, a shelf to store food is loaded on a guide rail formed on an inner wall of the main body to form a separate space such that the shelf can slide and be extracted. A cover is installed at a front side of the shelf to prevent leakage of cool air from the space to form the special cooling room.

Meanwhile, along with a recent trend of a large-sized refrigerator, a width of the front cover is also enlarged. Since the front cover is vertically rotated by hinges provided at opposite sides, a central portion of the front cover tends to droop.

The drooping of the front cover makes it difficult to maintain the special cooling room at a proper temperature. The drooping of the front cover may cause deformation or detachment of the front cover in the long run. Further, the drooping of the front cover may degrade an appearance of the refrigerator.

SUMMARY

The present embodiments have been made in order to solve the above problems. It is an aspect of the embodiments to prevent a central portion of a front cover from drooping down and prevent the deformation or detachment of the front cover.

Additional aspects and/or advantages will be set forth in part in the description which follows and, in part, will be apparent from the description, or may be learned by practice of the invention.

The foregoing and/or other aspects are achieved by providing a refrigerator including: a main body; a receiving portion defined within the main body; a shelf disposed within the receiving portion having at least one auxiliary hinge portion disposed at a rear thereof; a storage tray slidably extractable from within the receiving portion and adjacent the shelf when the storage tray is received within the receiving portion; and a front cover disposed on a front surface of the storage tray to be rotated upward and opened when the storage tray is extracted from within the receiving portion and having at least one holder portion disposed on a rear surface thereof to be coupled to the at least one auxiliary hinge portion.

The front cover may include hinge shafts disposed at opposite sites thereof and the main body may include internal opposite sidewalls and hinge grooves defined therein at the opposite sidewalls, the hinge shafts being receivable into the hinge grooves.

The at least one auxiliary hinge portion may include an auxiliary hinge shaft, the hinge shafts of the front cover and the auxiliary hinge shaft being disposed along a same axis.

The at least one auxiliary hinge portion may include an auxiliary hinge shaft coupled to the holder portion of the front cover when the front cover is attached to the auxiliary hinge portion and a support portion extended backward and bent from at least one side of the auxiliary hinge shaft to be connected to the shelf.

The at least one auxiliary hinge portion may include a groove defined within the at least one support portion such that an upper portion of the front cover is insertable into the groove when the front cover is opened in an upward direction.

The at least one auxiliary hinge portion may include at least one support portion protruded forward from the shelf and auxiliary hinge shafts disposed at opposite side portions of the at least one support portion to be coupled to the holder portion. A groove may be defined within the at least one support portion such that an upper portion of the front cover is insertable into the groove when the front cover is opened in an upward direction.

The storage tray may further include a sidewall to be extended upward and bent having an inclined portion disposed at a front side thereof, and wherein the front cover includes support pieces disposed at opposite sides of the front cover to come into contact with the inclined portion of the sidewall such that the inclined portion pushes the support pieces such that the front cover is rotated upward and opened when the storage tray is extracted forward.

The foregoing and/or other aspects are achieved by providing a refrigerator including: a main body; a receiving portion defined within the main body; a shelf disposed within the receiving portion and including at least one support portion disposed at a portion thereof; a storage tray slidably extractable from within the receiving portion and adjacent the shelf when the storage tray is received within the receiving portion; and a front cover disposed on a front surface of the storage tray to be rotated upward and opened when the storage tray is extracted from within the receiving portion and including at least one auxiliary hinge portion disposed a rear surface thereof to be coupled to the at least one support portion.

The at least one auxiliary hinge portion may include an auxiliary hinge shaft coupled to the at least one support portion and a connecting portion extended and bent backward from at least one side of the auxiliary hinge shaft and connected to a rear surface of the front cover, a holder portion is disposed at the at least one support portion and protruded upward from the shelf to be coupled to the auxiliary hinge shaft, and a groove defined within the at least one support portion such that an upper portion of the front cover is insertable into the groove when the front cover is opened upward.

The at least one auxiliary hinge portion may include a connecting portion protruded from a rear surface of the front cover and auxiliary hinge shafts disposed at opposite sides of the connecting portion, a holder portion is disposed at the at least one support portion and protruded upward from the shelf to be coupled to the auxiliary hinge shafts, and a groove is defined within the at least one support portion such that an upper portion of the front cover is insertable into the groove when the front cover is opened upward.

The storage tray may include a sidewall to be extended upward and bent having an inclined portion disposed at a front side thereof, and wherein the front cover includes support pieces disposed at opposite sides of the front cover to come into contact with the inclined portion of the sidewall such that the inclined portion pushes the support pieces such that the front cover is rotated upward and opened when the storage tray is extracted forward.

The front cover may include hinge shafts disposed at opposite sides thereof and the main body includes internal opposite sidewalls and hinge grooves defined therein at the opposite sidewalls, the hinge shafts being receivable into the hinge grooves.

The foregoing and/or other aspects are achieved by providing a refrigerator having a main body, including: a shelf disposed within the main body and including at least one auxiliary hinge portion; and a front cover to cover a storage tray receivable within the main body, the front cover having at least one holder portion disposed on a rear surface thereof to be coupled to the at least one auxiliary hinge portion.

BRIEF DESCRIPTION OF THE DRAWINGS

These and/or other aspects and advantages of the embodiments will become apparent and more readily appreciated from the following description of the embodiments, taken in conjunction with the accompanying drawings, of which.

DETAILED DESCRIPTION OF THE EMBODIMENTS

Figure 1:
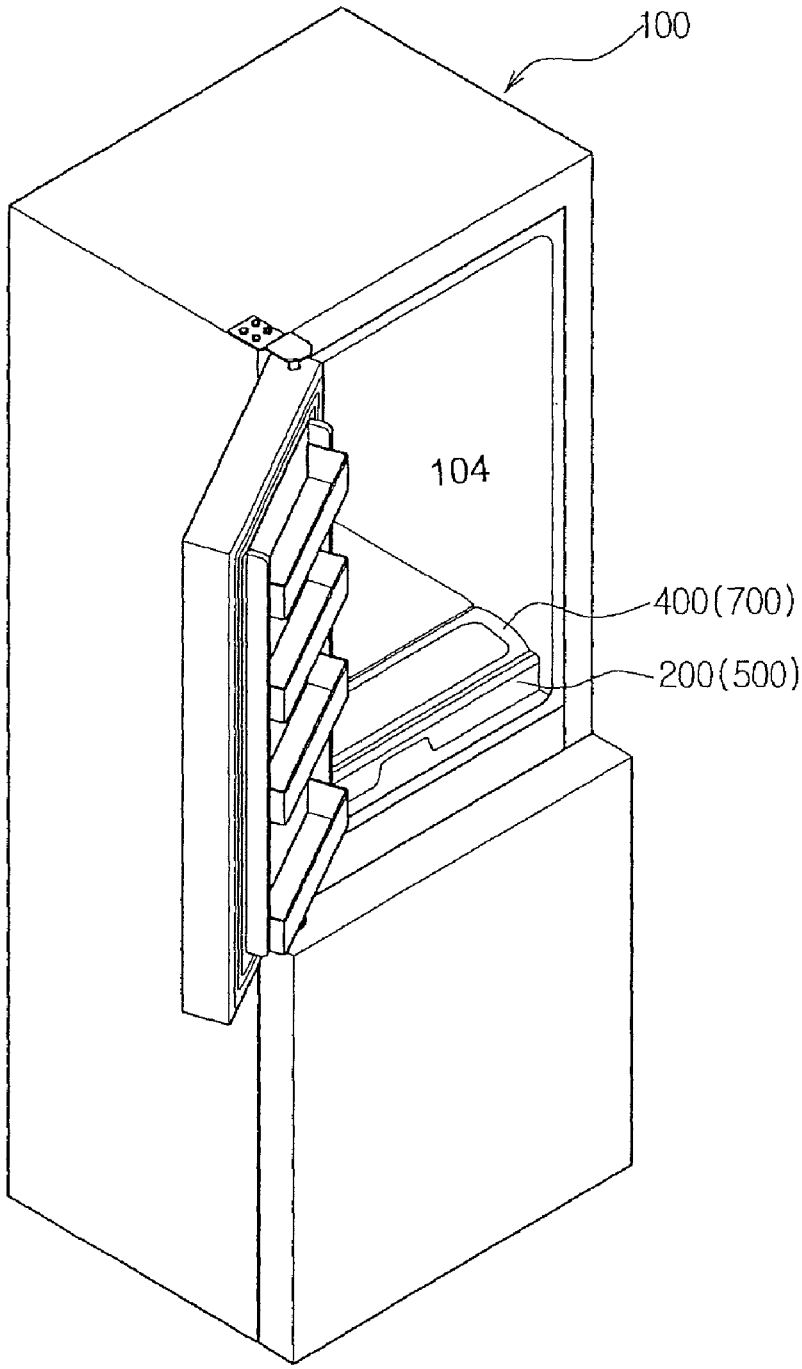
FIG. 1 shows an entire perspective view of a refrigerator according to a first embodiment.

Reference will now be made in detail to the embodiments, examples of which are illustrated in the accompanying drawings, wherein like reference numerals refer to like elements throughout. The embodiments are described below to explain the present invention by referring to the figures.

Figure 2:
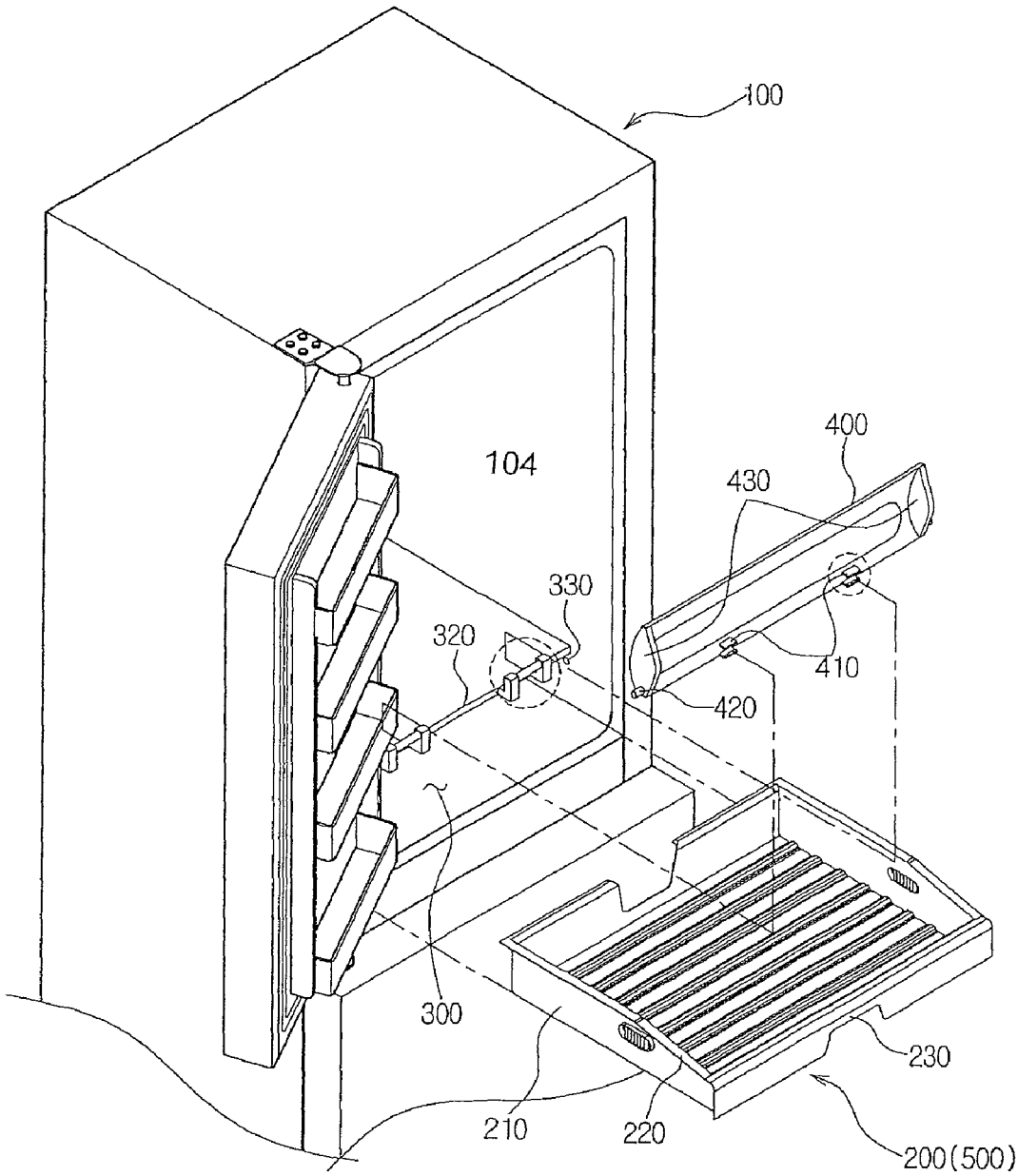
FIG. 2 shows an exploded view of a storage tray of the refrigerator according to the first embodiment.
Figure 3:
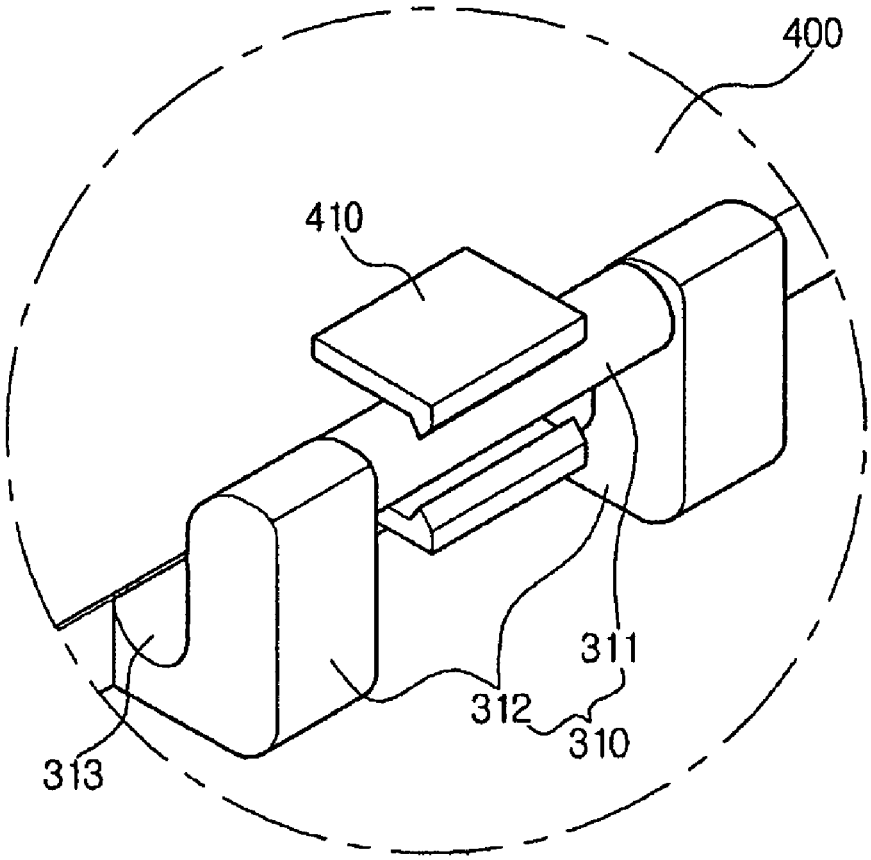
FIG. 3 shows a partial perspective view of an auxiliary hinge portion of the refrigerator according to the first embodiment.

Hereinafter, a first embodiment will be described in detail. FIG. 1 shows an entire perspective view of a refrigerator according to the first embodiment. FIG. 2 shows an exploded view of a storage tray of the refrigerator according to the first embodiment. FIG. 3 shows a partial perspective view of an auxiliary hinge portion of the refrigerator according to the first embodiment.

As shown in FIGS. 1 and 2, although a special cooling room is disposed at a lower portion of a cooling chamber 104 in this embodiment, the special cooling room may be disposed at an upper portion of the cooling chamber 104. A receiving portion 300 is disposed in an inner housing of a main body 100 to receive a storage tray 200. An upper shelf 320 is used to separate the receiving portion 300 from another portion of the cooling chamber 104. However, when the special cooling room is positioned at the upper portion of the cooling chamber 104, a lower shelf is disposed at a lower portion of the receiving portion 300 to separate the receiving portion 300 from the other portion of the cooling chamber 104.

The inside of the receiving portion 300 is used as a special cooling room which is maintained at a temperature of about 1° C. to 3° C., for example, to store food that specially requires freshness. However, a controller may be provided to vary the temperature distribution to store food which needs different treatment according to user demands.

While not shown, guide rails or guide rollers may be attached to inner opposite sides of the receiving portion 300 to be coupled to guide portions which may be provided at opposite sides of the storage tray 200 such that the storage tray 200 can be smoothly retracted into or extracted from the receiving portion 300.

The storage tray 200 is received in the receiving portion 300 and is slidably extracted forward. A handle 230 can be attached to a front portion of the storage tray 200 such that a user can grasp and pull the handle 230.

A sidewall 210 which is extended upward and bent is disposed around the storage tray 200, thereby preventing food from going outside of the storage tray 200. Inclined portions 220 are disposed at front opposite sides of the sidewall 210 of the storage tray 200. A front portion of the sidewall 210 connected to the inclined portions 220 has a smaller height than a rear portion of the sidewall 210. Irregularities may be formed at the bottom of the storage tray 200 and the sidewall 210 to reinforce the strength of the storage tray 200.

A front cover 400 is slidable extractable into and out of the receiving portion 300 to separate the special cooling room from the other portion of the cooling chamber. Hinge shafts 420 are provided at opposite sides of the front cover 400. Hinge grooves 330 are provided at opposite sidewalls of the receiving portion 300 to be coupled to the hinge shafts 420. Accordingly, the front cover 400 can rotate up and down with respect to the hinge shafts 420. A transparent window may be disposed at the front cover 400 to discriminate between stored products.

Support pieces 430 are disposed at opposite sides of the front cover 400. The support pieces 430 are formed in a soft round shape, for example, but may be formed in any shape capable of being received into the cooling chamber. The support pieces 430 are in contact with the inclined portions 220 of the storage tray 200 when the front cover 400 is closed. Accordingly, as the user extracts the storage tray 200 in a forward direction, the inclined portions 220 push the support pieces 430 when the front cover 400 is rotated upward and opened.

Along with the recent trend of a large-sized refrigerator, the width of the front cover 400 is also enlarged and the front cover 400 tends to droop. Accordingly, a plurality of auxiliary hinge portions 310 (shown in FIG. 3) is disposed in the receiving portion 300 adjacent to a rear upper portion of the front cover 400. Holder portions 410 capable of being elastically and detachably coupled to the auxiliary hinge portions 310 are disposed on the rear surface of the front cover 400.

FIG. 3 illustrates the auxiliary hinge portions 310 being disposed at a front portion of the upper shelf 320. The auxiliary hinge portions 310 include auxiliary hinge shafts 311 which are coupled to the holder portions 410 when the front cover 400 is attached to the auxiliary hinge portions 310 and support portions 312 which are extended and bent backward from the auxiliary hinge shafts 311 to be connected to a front portion of the upper shelf 320, respectively. The support portions 312 may be disposed only at one side or at opposite sides of the respective auxiliary hinge shafts 311. FIG. 3 shows a configuration in which the support portions 312 are disposed at opposite sides of the auxiliary hinge shafts 311. Although not shown in the drawings, the auxiliary hinge shafts may be disposed at opposite left and right sides of each support portion and each holder portion may have two portions which are coupled to the auxiliary hinge shafts. The auxiliary hinge shafts 311 and the hinge shafts 420 are disposed along the same axis, but may be disposed along different axes.

Since the support portions 312 may be in contact with the front cover 400, the front portion of the support portions 312 is formed to have a soft curved surface, for example, such that the front cover 400 can be smoothly rotated onto the support portions 312. Further, when the front cover 400 is opened upward, an upper portion of the front cover 400 may interfere with the support portions 312 to block the opening of the front cover 400. For smooth opening, grooves 313 may be formed on the support portions 312 such that the upper portion of the front cover 400 can be inserted into the grooves 313.

The support portions 312 may be reinforced to have a sufficient stiffness to prevent deformation and detachment of the front cover 400 and endure an external impact. Although two support portions 312 are shown in this embodiment, a different number of the support portions 312 may be provided according to the size of the refrigerator or a structural calculation.

Figure 4:
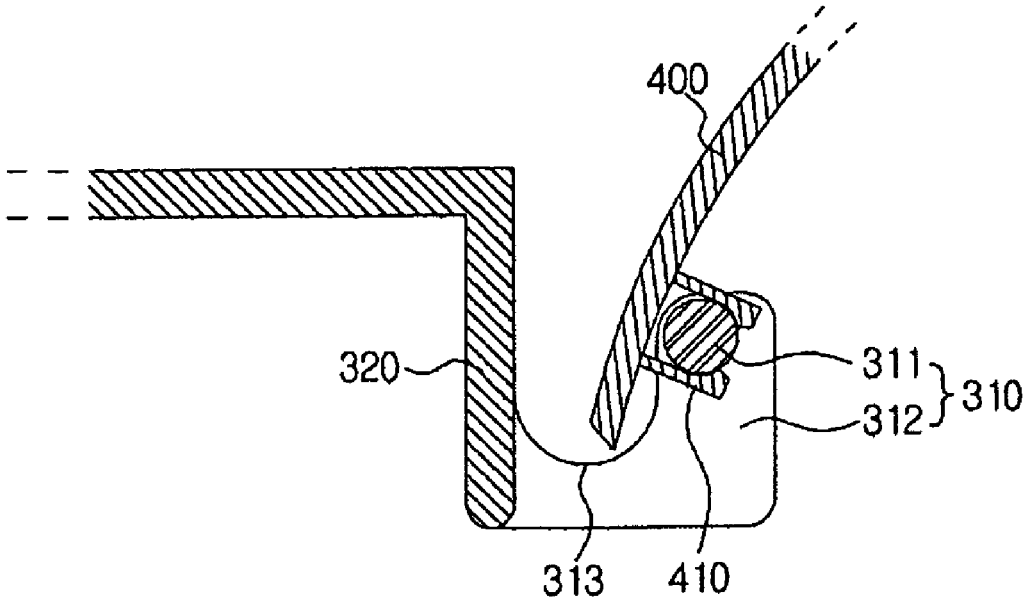
FIGS. 4A and 4B illustrate a partial cross-sectional view showing an operation of auxiliary hinge shafts and holder portions of the refrigerator according to the first embodiment.
Figure 4:
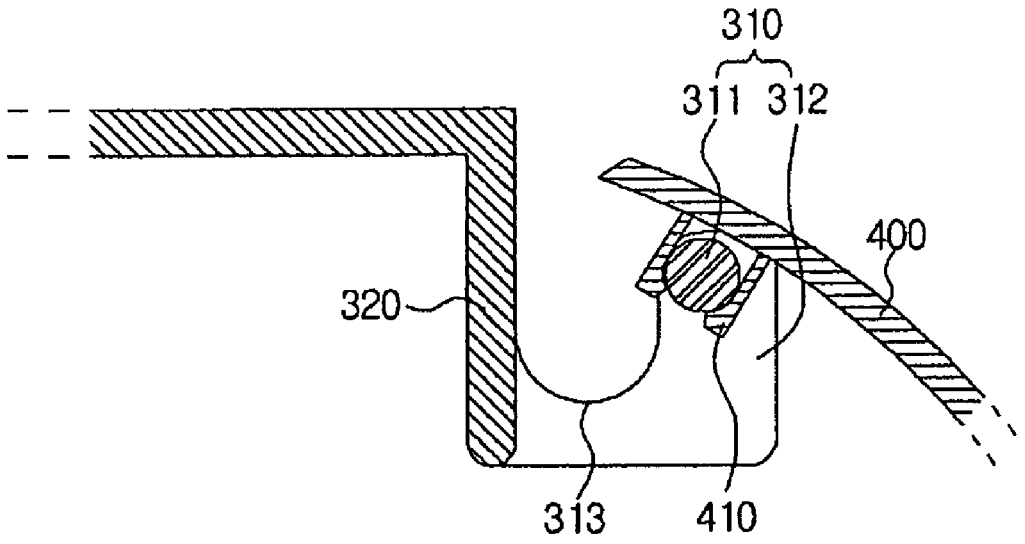

Hereinafter, the operation of the first embodiment will be described. FIG. 4 illustrates a partial cross-sectional view showing an operation of the auxiliary hinge shafts 311 of the auxiliary hinge portions 310 and the holder portions 410 of the front cover 400 according to the first embodiment.

When the user grasps the handle 230 disposed at the front portion of the storage tray 200 and extracts the storage tray 200 in a forward direction, the inclined portions 220 of the storage tray 200 push the support pieces 430 disposed at rear opposite sides of the front cover 400, and the front cover 400 is rotated upward and opened by the hinge shafts 420. In this case, the front cover 400 is rotated while the holder portions 410 of the front cover 400 are coupled to the auxiliary hinge shafts 311 of the auxiliary hinge portions 310, thereby preventing a central portion of the front cover 400 from drooping.

Hereinafter, a configuration of a refrigerator according to a second embodiment will be described. The description of the same configuration of the first and second embodiments will be omitted and the differences therebetween will be described in detail.

Figure 5:
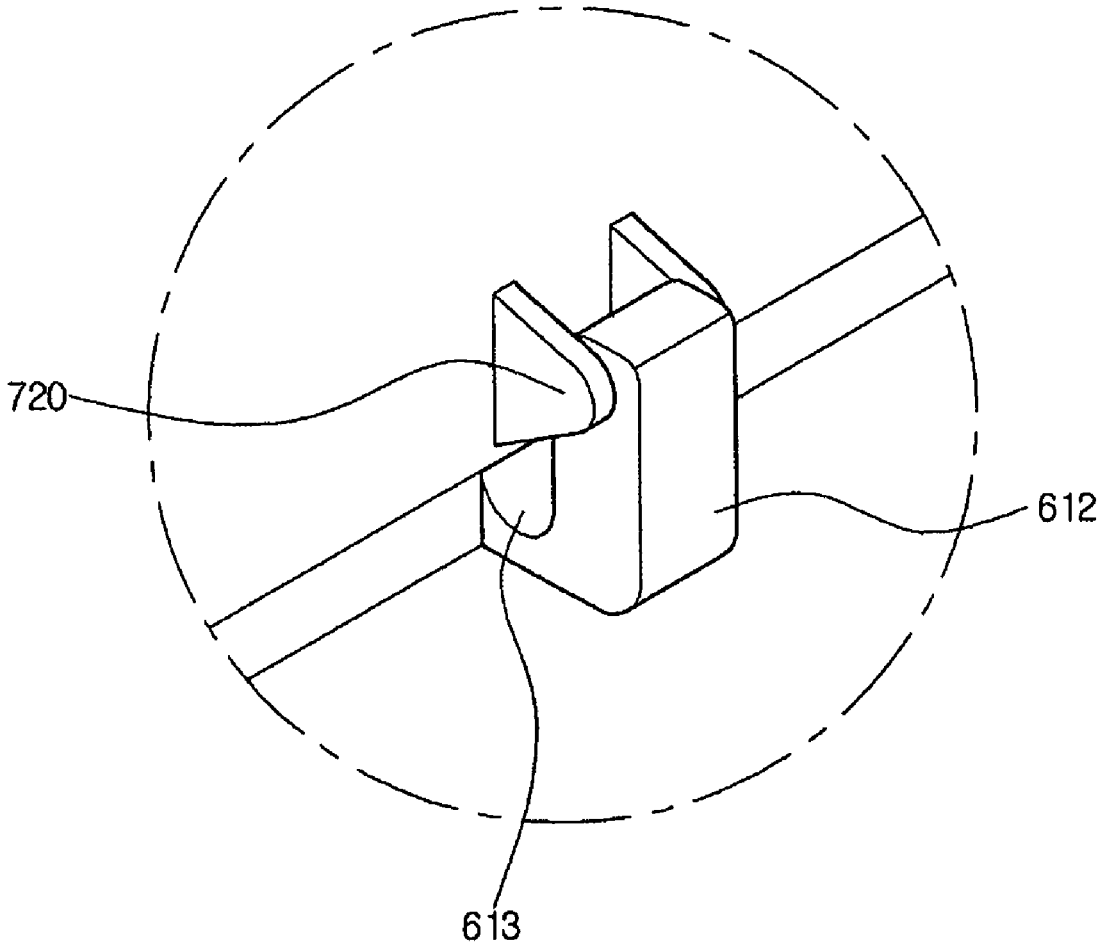
FIG. 5 shows a partial perspective view of an auxiliary hinge portion of the refrigerator according to a second embodiment.
Figure 6:
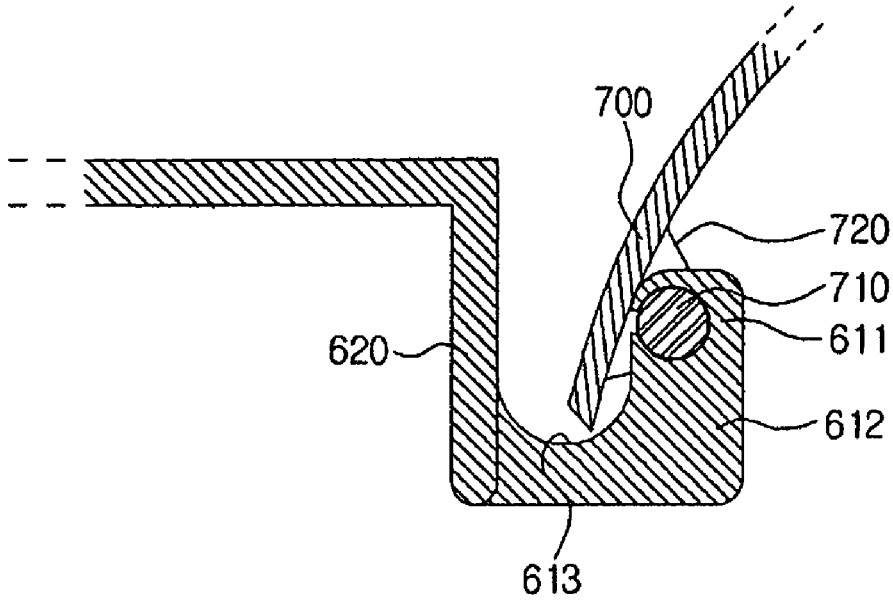
FIGS. 6A and 6B illustrate a partial cross-sectional view showing an operation of an auxiliary hinge shaft and a holder portion of the refrigerator according to the second embodiment.
Figure 6:
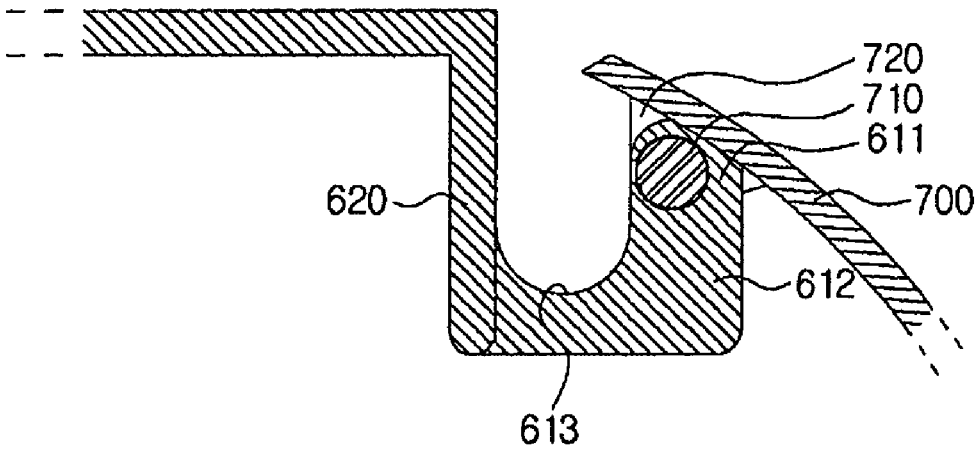

FIG. 5 shows a partial perspective view of an auxiliary hinge portion of the refrigerator according to the second embodiment. FIG. 6 illustrates a partial cross-sectional view showing an operation of an auxiliary hinge shaft and a holder portion of the refrigerator according to the second embodiment.

The auxiliary hinge portion according to the second embodiment includes an auxiliary hinge shaft 710 is disposed on a rear surface of a front cover 700 (shown in FIG. 6). The auxiliary hinge portion according to the second embodiment further includes a connecting portion 720 which is rounded and extended at one side or at opposite sides of the auxiliary hinge shaft 710 is formed to connect the auxiliary hinge shaft 710 to the front cover 700.

Meanwhile, a support portion 612 is disposed on a front portion of an upper shelf 620 to be coupled to the auxiliary hinge shaft 710. The support portion 612 is formed to be protruded forward from the front surface of an upper shelf 620. A holder portion 611 is disposed at a front upper side of the support portion 612 to be coupled to the auxiliary hinge shaft 710. An opened portion of the holder portion 611 may be disposed at a rear side to prevent detachment of the front cover 700. The support portion 612 includes a groove 613 into which an upper portion of the front cover 700 may be inserted.

Meanwhile, although not shown in the drawings, auxiliary hinge shafts may be disposed at opposite left and right sides of a connecting portion. A holder portion disposed at an upper end of a support portion may have two portions, or two support portions may be disposed such that the support portions are coupled to the auxiliary hinge shafts.

Hereinafter, the operation of the second embodiment will be described. FIG. 6 illustrates a partial cross-sectional view showing the operation of the auxiliary hinge shaft and the holder portion of the refrigerator according to the second embodiment.

In the same manner as the first embodiment, when the front cover 700 is rotated upward and opened, the auxiliary hinge shaft 710 connected to the front cover 700 is restricted into the holder portion 611 of the support portion 612, thereby preventing deformation and detachment of the front cover in the rotation.

Along with the trend of a large-sized refrigerator, the width of the storage tray is also enlarged and the front cover tends to droop or be deformed. By the configuration of the present embodiments, the front cover is structurally reinforced. Further, it is possible to prevent the front cover from drooping and prevent a gap between the front cover and the upper shelf. Furthermore, it is possible to improve an appearance.

Although embodiments have been shown and described, it would be appreciated by those skilled in the art that changes may be made in these embodiments without departing from the principles and spirit of the invention, the scope of which is defined in the claims and their equivalents.

What is claimed is:

1. A refrigerator comprising:

a body having an upper refrigerating chamber;

a receiving portion defined at a lower portion of the refrigerating chamber;

a shelf disposed in the refrigerating chamber to form an upper surface of the receiving portion, the shelf having a width corresponding to a width of the refrigerating chamber;

a storage tray slidably extractable from within the receiving portion;

a front cover disposed at a front side of the storage tray to be rotated upward or downward in link with an extracting or retracting operation of the storage tray;

hinge shafts disposed at opposite sides of the front cover, respectively, to rotatably support the front cover; and at least one rotation support disposed between the shelf and the front cover to prevent a central portion of the front cover from being deformed, wherein the at least one rotation support includes an auxiliary hinge portion extending from the shelf and having an auxiliary hinge shaft disposed coaxially with the hinge shafts, and a holder extending from the front cover to be coupled to the auxiliary hinge shaft, wherein the at least one auxiliary hinge portion further includes a support portion extending from a front portion of the shelf to the front side of the shelf, and a groove defined within the support portion to allow an upper portion of the front cover to be inserted into the groove when the front cover is opened upward.

2. The refrigerator according to claim 1, wherein the at least one rotation support is disposed adjacent to the central portion of the front cover.

3. The refrigerator according to claim 1, wherein the hinge shafts are spaced apart from the shelf.

4. The refrigerator according to claim 1, wherein the storage tray includes a sidewall to be extended upward and bent having an inclined portion disposed at a front side thereof, and wherein the front cover includes support pieces disposed at opposite sides of the front cover to come into contact with the inclined portion of the sidewall such that the inclined portion pushes the support pieces such that the front cover is rotated upward and opened when the storage tray is extracted forward.

5. A refrigerator comprising:

a body having an upper refrigerating chamber;

a receiving portion defined at a lower portion of the refrigerating chamber, the receiving portion having a width corresponding to a width of the refrigerating chamber;

a shelf disposed to form an upper surface of the receiving portion;

a storage tray slidably extractable from within the receiving portion to be adjacent to the shelf when the storage tray is received within the receiving portion;

a front cover disposed at a front side of the storage tray to be rotated about main hinge shafts respectively disposed at opposite sides of the front cover, so as to open or close a front upper portion of the storage tray;

at least one rotation support disposed between the shelf and the front cover to prevent a central portion of the front cover from being deformed, wherein the at least one rotation support includes a support portion extending from the shelf and having an auxiliary hinge shaft disposed coaxially with the main hinge shafts, and a holder extending from the front cover to be coupled to the auxiliary hinge shaft, wherein the at least one auxiliary hinge portion further includes a support portion extending from a front portion of the shelf to the front side of the shelf, and a groove defined within the support portion to allow an upper portion of the front cover to be inserted into the groove when the front cover is opened upward.

6. The refrigerator according to claim 5, wherein the storage tray includes a sidewall to be extended upward and bent having an inclined portion disposed at a front side thereof, and wherein the front cover includes support pieces disposed at opposite sides of the front cover to come into contact with the inclined portion of the sidewall such that the inclined portion pushes the support pieces such that the front cover is rotated upward and opened when the storage tray is extracted forward.

7. The refrigerator according to claim 5, wherein the at least one rotation support is disposed at opposite sides of the central portion of the front cover to be adjacent to the central portion of the front cover.

* * * * *